US011605924B2

(12) United States Patent
Kunze et al.

(10) Patent No.: US 11,605,924 B2
(45) Date of Patent: Mar. 14, 2023

(54) RADIO FREQUENCY CONNECTOR AND MEASUREMENT SYSTEM

(71) Applicant: Rohde & Schwarz GmbH & Co. KG, Munich (DE)

(72) Inventors: Alexander Kunze, Munich (DE); Stefan Ketzer, Munich (DE); Martin Peschke, Munich (DE)

(73) Assignee: Rohde & Schwarz GmbH & Co. KG, Munich (DE)

( * ) Notice: Subject to any disclaimer, the term of this patent is extended or adjusted under 35 U.S.C. 154(b) by 0 days.

(21) Appl. No.: 16/939,876

(22) Filed: Jul. 27, 2020

(65) Prior Publication Data

US 2022/0029365 A1 Jan. 27, 2022

(51) Int. Cl.
*H01R 24/54* (2011.01)
*H01R 13/66* (2006.01)
*H01R 103/00* (2006.01)

(52) U.S. Cl.
CPC ..... *H01R 24/542* (2013.01); *H01R 13/6683* (2013.01); *H01R 2103/00* (2013.01)

(58) Field of Classification Search
CPC ..... H01R 13/622; H01R 13/6683; H01R 9/0521; H01R 2103/00; H01R 24/542
USPC ..... 439/322
See application file for complete search history.

(56) References Cited

U.S. PATENT DOCUMENTS 2,986,720 A * 5/1961 Chess ..... H01R 9/0521 439/583
3,022,482 A * 2/1962 Waterfield ..... H01R 24/542 439/322
3,587,033 A * 6/1971 Brorein ..... H01R 9/0521 439/322
3,622,939 A * 11/1971 Forney, Jr. ..... H01R 9/0521 439/322
4,443,052 A * 4/1984 Eaby ..... H01R 13/622 439/322

(Continued)

FOREIGN PATENT DOCUMENTS

GB 2512822 A 10/2014

*Primary Examiner* — Gary F Paumen
(74) *Attorney, Agent, or Firm* — Christensen O'Connor Johnson Kindness PLLC

(57) ABSTRACT

A radio frequency connector for establishing a radio frequency connection with a radio frequency device is described. The radio frequency connector includes a radio frequency connection interface, an interchangeable radio frequency adapter and a positioning member. The interchangeable radio frequency adapter is detachably attached with the radio frequency connection interface such that the interchangeable radio frequency adapter is configured to be detached from the radio frequency connection interface in a disassembled state of the radio frequency connector. The positioning member is configured to position the interchangeable radio frequency adapter with respect to the radio frequency connection interface in an assembled state of the radio frequency connector. The positioning member is detachably attached such that the positioning member is configured to be detached in the disassembled state of the radio frequency connector, thereby releasing the interchangeable radio frequency adapter with respect to the radio frequency connection interface. Further, a measurement system for radio frequency measurement is described.

19 Claims, 2 Drawing Sheets

(56) References Cited

U.S. PATENT DOCUMENTS

| | | | | | |
|---|---|---|---|---|---|
| 5,439,386 | A * | 8/1995 | Ellis | H01R 13/622 | 439/271 |
| 5,571,028 | A * | 11/1996 | Szegda | H01R 9/0521 | 439/277 |
| 7,063,551 | B1 * | 6/2006 | Lin | H01R 13/622 | 439/322 |
| 7,717,725 | B2 * | 5/2010 | Montena | H02G 15/013 | 439/277 |
| 8,025,518 | B2 * | 9/2011 | Burris | H01R 24/40 | 439/322 |
| 8,075,337 | B2 * | 12/2011 | Malloy | H01R 13/187 | 439/578 |
| 8,529,294 | B2 * | 9/2013 | Blasick | H01R 9/05 | 439/583 |
| 8,753,137 | B2 * | 6/2014 | Lu | H01R 9/0524 | 439/322 |

* cited by examiner

RADIO FREQUENCY CONNECTOR AND MEASUREMENT SYSTEM

FIELD OF THE DISCLOSURE

The present disclosure relates to a radio frequency connector for establishing a radio frequency connection with a radio frequency device, for instance a probe device. Further, the present disclosure generally relates to a measurement system for radio frequency measurement.

BACKGROUND

Measurement systems are known in the state of the art that are used for radio frequency measurement of a device under test. The respective measurement system typically comprises a measurement device, for instance an oscilloscope, that has a radio frequency port that can be connected with a probe device. The probe device is used for probing a signal of the device under test, which relates to the radio frequency signal.

It is generally known that different radio frequency devices, for instance different probe devices, can be connected with the measurement device. However, the respective radio frequency connector has to be exchanged in case of a different concept or rather size provided by the radio frequency device to be connected with the measurement device. Furthermore, it might also happen that the radio frequency port has to be exchanged due to failure associated with the number of mating and/or screw cycles. Generally, the failure may result in characteristics that are out of scope of the specification provided for the respective radio frequency connector.

Accordingly, the radio frequency ports provided at the measurement device have to be exchanged which is time-consuming.

In GB 2512822 A, a coaxial connector is provided that shall simplify the exchange of a radio frequency interface provided by a radio frequency port. For this purpose, the coaxial connector comprises an interchangeable connector part that can be connected with a separately formed receiving sleeve part. Both parts, namely the sleeve part and the interchangeable connector part, each comprise a threaded portion such that both parts can be screwed within each other. In addition, the coaxial connector comprises an outer locking nut that only interacts with the receiving sleeve part and a casing wall. Hence, the locking nut does not interact with the interchangeable connector part that is simply screwed into the receiving sleeve part by means of the respective threaded portions.

However, the screwing is prone to failure since the interchangeable connector part may be damaged by the screwing cycles. Moreover, it is not ensured that the connector part is correctly screwed in, resulting in characteristics that may be out of scope of the specification.

Accordingly, there is a need for a simpler and cost-efficient radio frequency connector that ensures an easy exchange.

SUMMARY

The present disclosure provides examples of a radio frequency connector for establishing a radio frequency connection with a radio frequency device. In an embodiment, the radio frequency connector comprises a radio frequency connection interface, an interchangeable radio frequency adapter and a positioning member. The interchangeable radio frequency adapter is detachably attached with the radio frequency connection interface such that the interchangeable radio frequency adapter is configured to be detached from the radio frequency connection interface in a disassembled state of the radio frequency connector. The positioning member is configured to position the interchangeable radio frequency adapter with respect to the radio frequency connection interface in an assembled state of the radio frequency connector. The positioning member is detachably attached such that the positioning member is configured to be detached in the disassembled state of the radio frequency connector, thereby releasing the interchangeable radio frequency adapter with respect to the radio frequency connection interface.

The present disclosure ensures that the interchangeable radio frequency adapter can be exchanged easily by detaching the positioning member and the interchangeable radio frequency adapter. The positioning member has to be detached firstly in order to release the interchangeable radio frequency adapter such that the interchangeable radio frequency adapter can be detached and removed.

Since the positioning member has to be detached firstly, the interchangeable radio frequency adapter is secured by the positioning member, thereby avoiding any inadvertent detachment of the interchangeable radio frequency adapter. Put differently, the positioning member releases the interchangeable radio frequency adapter provided that the positioning member is detached previously. Nevertheless, an easy exchange of the interchangeable radio frequency adapter is possible once the positioning member has been detached. In other words, the positioning member prevents the interchangeable radio frequency adapter from an unwanted or rather inadvertent detachment since the positioning member has to be detached previously, thereby releasing the interchangeable radio frequency adapter such that the interchangeable radio frequency adapter can be detached.

Moreover, the interchangeable radio frequency adapter is positioned or rather aligned with respect to the radio frequency connection interface in a predefined manner in the assembled state of the radio frequency connector by the positioning member. Therefore, the positioning member interacts with the interchangeable radio frequency adapter (directly). In other words, the positioning member positions/aligns the interchangeable radio frequency adapter with respect to the radio frequency connection interface such that center axes of the interchangeable radio frequency adapter and the radio frequency connection interface coincide. This ensures optimal transmission characteristics of the radio frequency connector in its assembled state.

Generally, the interchangeable radio frequency adapter may correspond to a sacrificial radio frequency adapter that can be replaced easily once it is worn without the need of replacing the radio frequency port integrated in the radio frequency device, for instance the measurement device or rather test instrument. This ensures that the overall costs, for example the maintenance costs, can be reduced significantly since the interchangeable radio frequency adapter is replaced instead of the entire radio frequency port. Moreover, the replacement can be done in an easy and fast manner, for example by a customer himself. Thus, the radio frequency device does not require any professional service.

In addition, it is also possible to provide different radio frequency interfaces for other radio frequency devices due to the interchangeable radio frequency adapter that can be replaced easily by another one having a differently sized radio frequency interface. Accordingly, different sized radio frequency interfaces may be established easily, for example by the customer himself.

An aspect provides that the positioning member also locks the interchangeable radio frequency adapter with respect to the radio frequency connection interface in the assembled state of the radio frequency connector. The locking functionality of the positioning member ensures that the interchangeable radio frequency adapter cannot be detached accidentally or inadvertently as it is secured. The radio frequency connector remains in its assembled state until the positioning member was detached previously, thereby unlocking the interchangeable radio frequency adapter.

In contrast to a simple screwing connection used in the prior art, the interchangeable radio frequency adapter cannot be disassembled by unscrewing the interchangeable radio frequency adapter.

Generally, the interchangeable radio frequency adapter may be put on the radio frequency connection interface such that the interchangeable radio frequency adapter accommodates the radio frequency connection interface at least partly. The connection between the interchangeable radio frequency adapter and the radio frequency connection interface may be established by a screwing connection that is provided additionally to the attachment done via the positioning member.

In other words, the interchangeable radio frequency adapter is put on the radio frequency connection interface, for example screwed in. Afterwards, the positioning member is attached, thereby aligning the interchangeable radio frequency adapter with respect to the radio frequency connection interface such that their center axes coincide. Moreover, the positioning member also locks the interchangeable radio frequency adapter once the positioning member is attached such that the interchangeable radio frequency adapter cannot be detached accidentally or inadvertently.

Another aspect provides that the radio frequency connector comprises a base. The base may be part of a housing of the radio frequency connector. The housing may generally comprise several parts. Moreover, the base may comprise or at least partially surround the radio frequency connection interface. The radio frequency connection interface may be connected with the base.

The base may comprise a passage into which the radio frequency connection interface and the interchangeable radio frequency adapter extend at least partly. The passage may have a threaded section that interacts with a threaded section of the interchangeable radio frequency adapter via which the interchangeable radio frequency adapter is screwed in.

In some embodiments, the passage has an axial length that ensures that a connection between the radio frequency connection interface and the interchangeable radio frequency adapter is established in an area that is at least partially encompassed by the base, for example the passage.

For instance, the positioning member is in engagement with the base in the assembled state of the radio frequency connector. The positioning member is attached to the base, thereby ensuring the defined positioning or rather aligning of the interchangeable radio frequency adapter with respect to the radio frequency connection interface. As already mentioned, the respective alignment may ensure that the center axes of the interchangeable radio frequency adapter and the radio frequency connection interface coincide with each other.

In some embodiments, the engagement between the positioning member and the base is established by a threaded connection. The positioning member may have a first threaded portion via which the positioning member is screwed on the base that has a second threaded portion interacting with the first one. The threaded connection ensures that the positioning member positions the interchangeable radio frequency adapter appropriately.

The positioning member may position the interchangeable radio frequency adapter in axial direction and/or in radial direction with respect to the center axis of the interchangeable radio frequency adapter.

The center axis may be an axis of symmetry of the interchangeable radio frequency adapter that is formed rotationally symmetric.

Generally, the positioning member and/or the radio frequency connection interface may also be established in a rotationally symmetric manner.

According to another aspect, the positioning member accommodates the interchangeable radio frequency adapter circumferentially. The interchangeable radio frequency adapter may be inserted into the positioning member from an inner side of the positioning member that faces the base of the radio frequency connector in the assembled state. The positioning member may be formed in a cup-shaped manner, wherein an opening is provided through which the interchangeable radio frequency radio adapter extends partly.

The interchangeable radio frequency adapter may have a protrusion. The protrusion may be provided on the outer surface of the interchangeable radio frequency adapter such that the protrusion can be used by the positioning member for aligning the interchangeable radio frequency adapter appropriately.

In some embodiments, the positioning member has an inner shoulder portion that engages with the protrusion. The inner shoulder portion of the positioning member is orientated towards the interchangeable radio frequency adapter in the assembled state. The inner shoulder portion contacts the protrusion when the positioning member is attached, thereby aligning the interchangeable radio frequency adapter with respect to the radio frequency connection interface such that their center axes coincide.

The radio frequency connector may be assembled by providing the positioning member, the radio frequency connection interface and the interchangeable radio frequency adapter.

In a first assembling step, the interchangeable radio frequency adapter may be connected to the radio frequency connection interface, for instance by screwing the interchangeable radio frequency adapter into the base. Then, the positioning member is placed on the interchangeable radio frequency adapter, thereby accommodating the interchangeable radio frequency adapter at least partly. Alternatively, the positioning member is placed in the positioning member previously, thereby establishing an assembly that is put on the radio frequency connection interface.

In any case, the positioning member is attached to the base by screwing the positioning member onto the outer thread portion of the base afterwards, thereby moving the positioning member towards the base in an axial direction. This relative movement positions and/or aligns the interchangeable radio frequency adapter with respect to the radio frequency connection interface, namely in an axial direction and/or radial direction such that the interchangeable radio frequency adapter gets aligned accordingly. This is ensured by the inner shoulder portion of the positioning member which interacts with the protrusion of the interchangeable radio frequency adapter when the positioning member is moved along the axial direction due the screwing. At the end, the assembled state of the radio frequency connector is obtained.

Furthermore, the positioning member may have an outer rim portion to be engaged by another or second radio frequency device, for instance a probe device, with which the radio frequency connector establishes the radio frequency connection. The outer rim portion may center the second radio frequency device with respect to the radio frequency connector when establishing the radio frequency connection, thereby aligning respective center axes accordingly. Hence, it is ensured that the radio frequency connection is a secure one with predefined characteristics since the second radio frequency device is connected with the radio frequency connector in a secure and defined manner.

Generally, the outer rim portion is, for example at least partially, ring shaped. The outer rim portion ensures correct (pre-)positioning of the second the radio frequency device and the radio frequency connector with respect to each other.

Further, the radio frequency connection interface may be a coaxial radio frequency connection interface. The coaxial radio frequency connection interface defines the central axis that corresponds to the one of the interchangeable radio frequency adapter.

Moreover, the interchangeable radio frequency adapter may be an interchangeable coaxial radio frequency adapter. The interchangeable radio frequency adapter is configured to establish a coaxial radio frequency connection with the coaxial radio frequency connection interface.

Furthermore, the present disclosure provides examples of a measurement system for radio frequency measurement, wherein the measurement system comprises a radio frequency device and a radio frequency connector as defined in any one of the embodiments above. The radio frequency connector may be connected with the radio frequency device, thereby ensuring that another radio frequency device can be connected to the radio frequency device in an appropriate manner, for instance a probe device.

The measurement system may also comprise another radio frequency device that is connected with the radio frequency connector. The radio frequency connector ensures that the second radio frequency device establishes the radio frequency connection to internal components of the radio frequency device.

The second radio frequency device may be connected with a free end of the interchangeable radio frequency adapter, wherein the free end is located opposite to the radio frequency connection interface. The free end of the interchangeable radio frequency adapter is the one that is used for connecting external devices such as the second radio frequency device.

The second radio frequency device may be a probe device. The probe device may be used for probing a device under test which provides a radio frequency signal that can be processed accordingly. The radio frequency connector ensures that the radio frequency signal is forwarded to the radio frequency device.

For instance, the radio frequency device may be an oscilloscope, a network analyzer, a signal generator, a signal analyzer, a spectrum analyzer, etc. All of these different devices can be used for radio frequency processing, wherein external radio frequency devices may be connected with one of the respective radio frequency interfaces of the radio frequency device. The radio frequency interfaces may be established by any of the respective radio frequency connectors mentioned above.

Moreover, a second interchangeable radio frequency adapter may be provided that has a different size compared to the interchangeable radio frequency adapter. The interchangeable radio frequency adapter may be replaced by the second interchangeable radio frequency adapter with the different size such that the radio frequency device is enabled to be connected with a respective second radio frequency device, for instance a second probe device, that requires a differently sized radio frequency interface. The interchangeable radio frequency adapter, for example its free end, provides the respective radio frequency interface for the second or another radio frequency device.

The radio frequency device has a fixed radio frequency port that provides the radio frequency connection interface to which the interchangeable radio frequency adapter is connected. Since the interchangeable radio frequency adapter can be exchanged, the fixed radio frequency port or rather the radio frequency connection interface is maintained.

The free ends of the respective interchangeable radio frequency adapters may be sized differently, thereby ensuring that differently sized second radio frequency devices can be connected to the respective radio frequency device having the radio frequency connector.

Hence, the interchangeable radio frequency adapter may be exchanged in order to provide a radio frequency interface with different dimensions. Thus, the respective size required by the second radio frequency device, for instance the probe device, can be provided appropriately.

Generally, the radio frequency connector provides a sacrificial interface to the radio frequency device, for example the measurement device or test instrument, thus protecting the respective radio frequency front panel connector from mechanical damage, namely the radio frequency port.

As mentioned above, the radio frequency port corresponds to the radio frequency connection interface.

After prolonged use of the radio frequency connector, the interchangeable radio frequency adapter of the radio frequency connector may be exchanged without a need for service to the radio frequency port of the radio frequency device. Generally, the exchange may be done by the customer itself without the need for a professional service.

DESCRIPTION OF THE DRAWINGS

The foregoing aspects and many of the attendant advantages of the claimed subject matter will become more readily appreciated as the same become better understood by reference to the following detailed description, when taken in conjunction with the accompanying drawings, wherein:

DETAILED DESCRIPTION

The detailed description set forth below in connection with the appended drawings, where like numerals reference like elements, is intended as a description of various embodiments of the disclosed subject matter and is not intended to represent the only embodiments. Each embodiment described in this disclosure is provided merely as an example or illustration and should not be construed as preferred or advantageous over other embodiments. The illustrative examples provided herein are not intended to be exhaustive or to limit the claimed subject matter to the precise forms disclosed.

Figure 1:
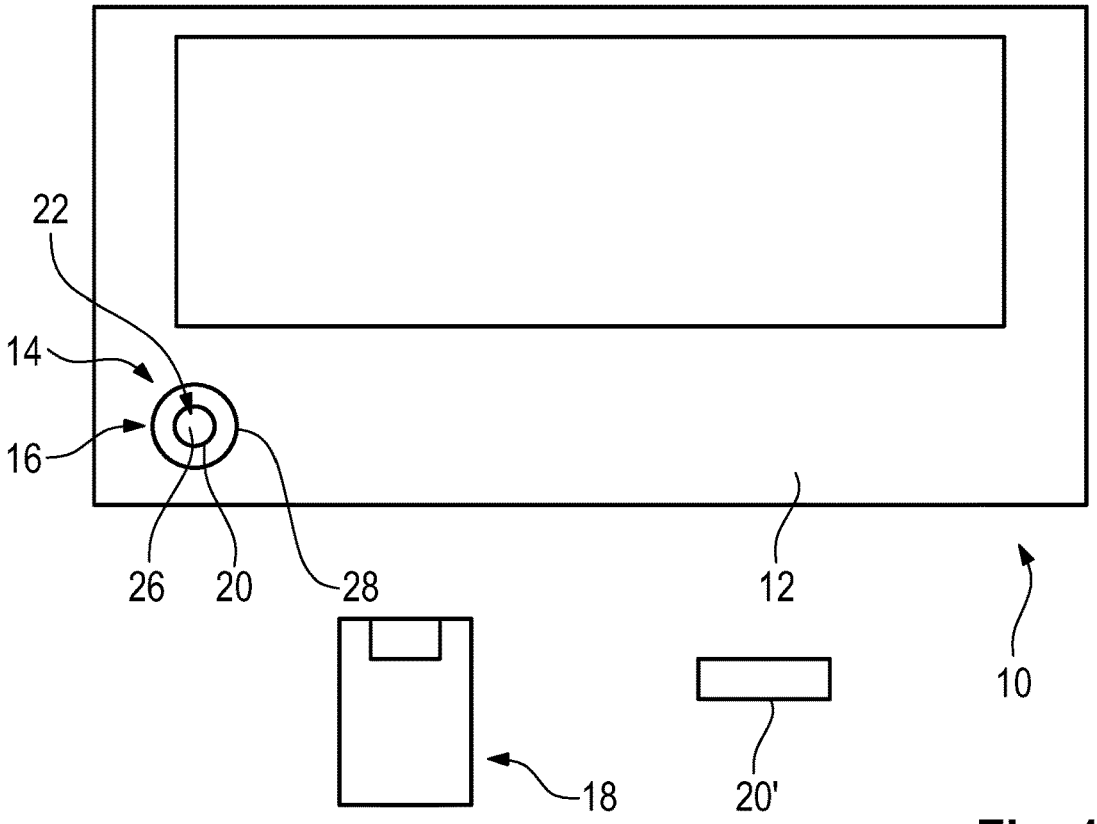
FIG. 1 schematically shows a measurement system according to an embodiment of the present disclosure.

In FIG. 1, a measurement system 10 for radio frequency measurement is shown. The measurement system 10 comprises a (first) radio frequency device 12 that has at least one radio frequency port 14 that is associated with a radio frequency connector 16 as will be described later in more detail with reference to FIGS. 2 and 3.

The measurement system 10 also comprises another, or second, radio frequency device 18 that can be connected with the radio frequency connector 16 associated with the radio frequency device 12 in order to establish a radio frequency connection.

For instance, the second radio frequency device 18 is provided by a probe device that can be used for probing a device under test that provides a radio frequency signal to be analysed by the radio frequency device 12.

Accordingly, the radio frequency device 12 may be an oscilloscope, a network analyser, a signal analyser or a spectrum analyser, etc. However, the radio frequency device 12 may also be a signal generator that generates a radio frequency signal to be transmitted via the radio frequency connector 16. Accordingly, the radio frequency device 12 corresponds to a test instrument.

Figure 2:
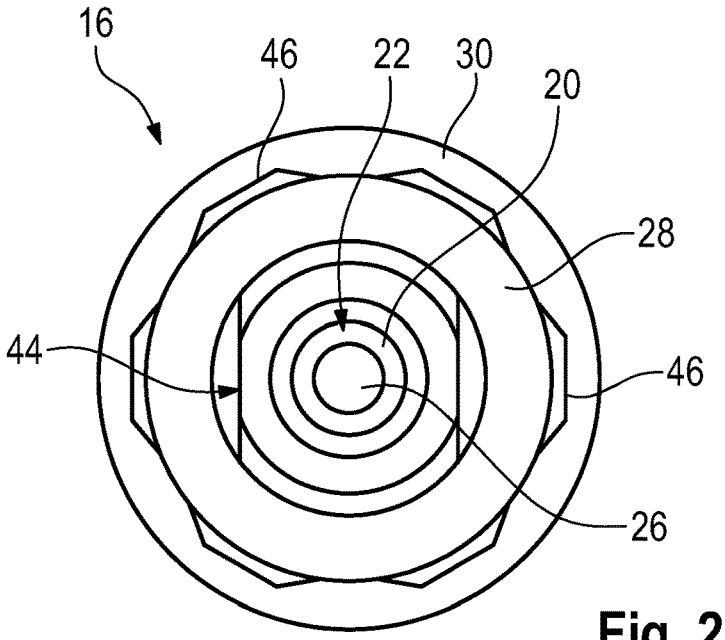
FIG. 2 shows a schematic overview of a radio frequency connector according to an embodiment of the present disclosure.
Figure 3:
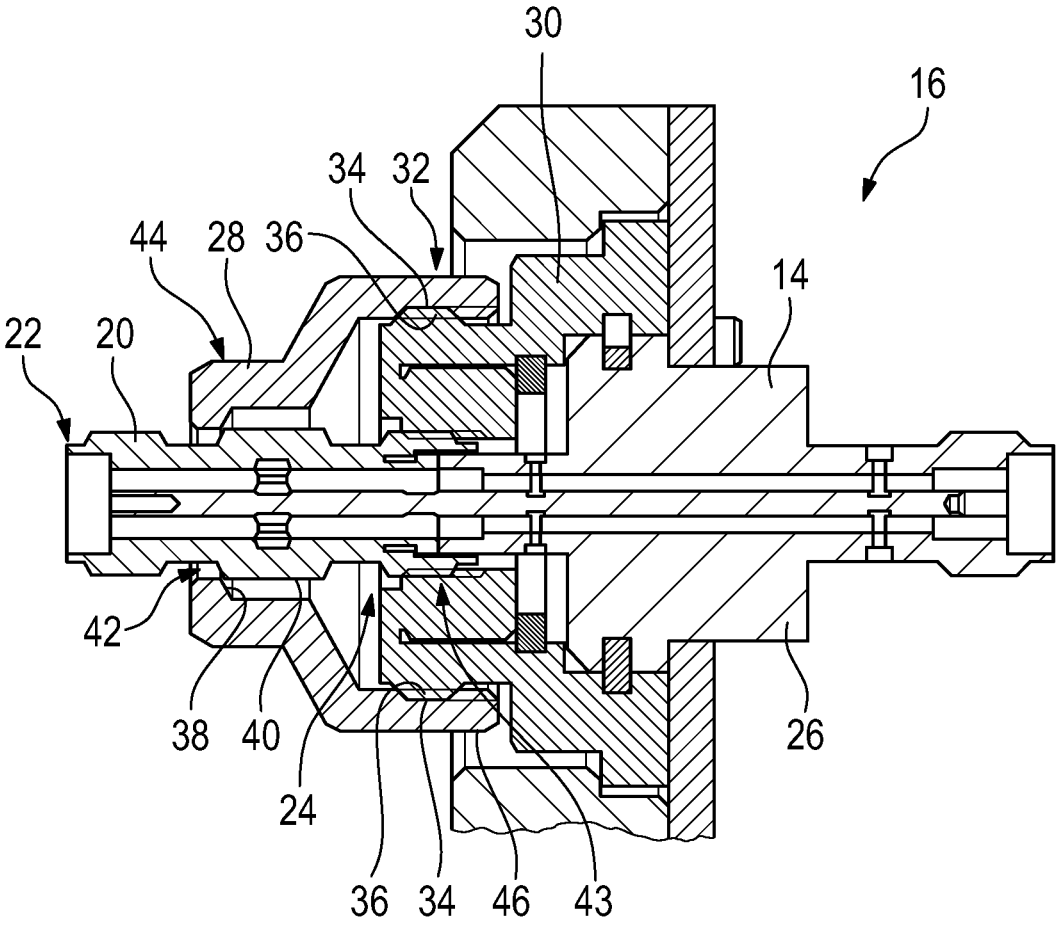
FIG. 3 shows a schematic sectional view of the radio frequency connector shown in FIG. 2.

In FIGS. 2 and 3, the radio frequency connector 16 is shown in more detail. As shown in FIGS. 2 and 3, The radio frequency connector 16 comprises an interchangeable radio frequency adapter 20 that has a free end 22 to be connected with the second radio frequency device 18. Hence, the interchangeable radio frequency adapter 20, for example its free end 22, establish the radio frequency interface to be connected by external devices.

The interchangeable radio frequency adapter 20 is connected with a radio frequency connection interface 26 via its opposite end 24. As shown in FIG. 3, the radio frequency connection interface 26 may be established by the radio frequency port 14 of the radio frequency device 12, which is fixed.

In addition, the radio frequency connector 16 has a positioning member 28 that is used to position the interchangeable radio frequency adapter 20 with respect to the radio frequency connection interface 26 as will be described later. In general, the interchangeable radio frequency adapter 20 as well as the positioning member 28 both are detachably attached such that they can be detached and removed if desired.

The interchangeable radio frequency adapter 20 can be replaced with another one, for instance a second interchangeable radio frequency adapter 20' that is schematically shown in FIG. 1. The second interchangeable radio frequency adapter 20' may have a different size compared to the interchangeable radio frequency adapter 20. The size is associated with the respective free end 22 as this establishes the radio frequency interface for external devices. The opposite end 24 may be sized in a similar manner in order to ensure that the differently sized interchangeable radio frequency adapters 20, 20' can be connected to the same radio frequency connection interface 26.

Accordingly, the interchangeable radio frequency adapter 20 may be replaced in order to provide another sized radio frequency interface. Moreover, the interchangeable radio frequency adapter 20 may be replaced in order to provide a new one provided that the former one does not fulfil the respective specifications anymore while being worn after a certain period of time.

As already mentioned, the interchangeable radio frequency adapter 20 is detachably attached with the radio frequency connection interface 26. However, the interchangeable radio frequency adapter 20 is secured by the positioning member 28 that also positions or rather aligns the interchangeable radio frequency adapter 20 accordingly while impinging the interchangeable radio frequency adapter 20 towards the radio frequency connection interface 26 in the assembled state of the radio frequency connector 16.

In other words, the positioning member 28 positions and aligns the interchangeable radio frequency adapter 20 with respect to the radio frequency connection interface 26 such that the center axes of the positioning member 28 and the radio frequency connection interface 26 coincide.

However, the positioning member 28 that is detachably attached also ensures that the interchangeable radio frequency adapter 20 is only released in case of detaching the positioning member 28 previously. Thus, the positioning member 28 locks the interchangeable radio frequency adapter 20 with respect to the radio frequency connection interface 26 in the assembled state of the radio frequency connector 16.

The radio frequency connector 16 has a base 30 to which the positioning member 28 is attached in the assembled state. In other words, the positioning member 28 is in engagement with the base 30.

As shown in FIG. 3, the engagement between the positioning member 28 and the base 30 is established by a threaded connection 32. The positioning member 28 has an inner thread portion 34 that interacts with an outer thread portion 36 provided at the base 30 such that the positioning member 28 can be screwed onto the base 30. This ensures that the interchangeable radio frequency adapter 20 gets aligned with respect to the radio frequency connection interface 26 while screwing the positioning member 28 onto the base 30. The thread portions 34, 36 are provided in a ring-shaped manner along the inner surface of the positioning member 28 and the outer surface of the base 30, respectively.

In order to ensure the alignment of the interchangeable radio frequency adapter 20 with respect to the radio frequency connection interface 26, the positioning member 28 has an inner shoulder portion 38 that engages with a protrusion 40 provided at an outer surface of the interchangeable radio frequency adapter 20.

The interaction between the protrusion 40 and the inner shoulder portion 38 ensures that the interchangeable radio frequency adapter 20 gets aligned in a radial direction and/or axial direction concerning the radio frequency connection interface 26 when the positioning member 28 is screwed onto the base 30. When the positioning member 28 is screwed onto the base 30, the positioning member 28 is moved in an axial direction such that the inner shoulder portion 38 gets in contact with the protrusion 40.

Since the inner shoulder portion 38 and/or the protrusion 40 are/is ring-shaped, the axial movement of the positioning member 28 results in an axial alignment as well as a radial alignment of the interchangeable radio frequency adapter 20.

As shown in FIG. 3, the positioning member 28 accommodates the interchangeable radio frequency adapter 20 circumferentially, wherein the positioning member 28 has a central opening 42 through which the interchangeable radio frequency adapter 20 partly extends in the assembled state, namely by its free end 22 to be connected with the second radio frequency device 18.

Generally, the interchangeable radio frequency adapter 20 may be screwed into the base 30 previously, namely in an area associated with a passage 43 provided by the base 30. Accordingly, the base 30 and the interchangeable radio frequency adapter 20 establish a threaded connection that is supported by the positioning member 28 in order to position/align the interchangeable radio frequency adapter 20 accurately.

In addition, the positioning member 28 has an outer rim portion 44 that can be engaged by the second radio frequency device 18. The outer rim portion 44 is used to centralize the second radio frequency device 18 and the radio frequency connector 16 with respect to each other when establishing the radio frequency connection between them. This ensures a secure radio frequency connection between the radio frequency connector 16 and the second radio frequency device 18.

In addition, the positioning member 28 has outwardly extending engagement portions 46 that can be used for screwing the positioning member 28 onto the base 30. Hence, the attachment of the positioning member 28 as well as its detachment is simplified such that it can be done by the customer himself.

Generally, the radio frequency connection interface 26 and/or the interchangeable radio frequency adapter 20 may be coaxial ones, thereby ensuring that a coaxial radio frequency connection is established between the radio frequency device 12 and the second radio frequency device 18 via the radio frequency connector 16.

The positioning, alignment and/or locking of the interchangeable radio frequency adapter 20 due to the positioning member 28 ensures that the interchangeable radio frequency adapter 20 is always located in the predefined relative orientation with respect to the radio frequency connection interface 26, thereby ensuring optimal characteristics. In addition, the positioning member 28 directly interacts with the interchangeable radio frequency adapter 20 in order to align, position and/or lock the interchangeable radio frequency adapter 20.

Accordingly, an inadvertent detaching of the interchangeable radio frequency adapter 20 is avoided effectively since the positioning member 28 has to be detached previously in order to enable the detachment of the interchangeable radio frequency adapter 20 afterwards. Therefore, a secure and cost-efficient radio frequency connector 16 is provided.

The present application may reference quantities and numbers. Unless specifically stated, such quantities and numbers are not to be considered restrictive, but exemplary of the possible quantities or numbers associated with the present application. Also in this regard, the present application may use the term "plurality" to reference a quantity or number. In this regard, the term "plurality" is meant to be any number that is more than one, for example, two, three, four, five, etc. The terms "about," "approximately," "near," etc., mean plus or minus 5% of the stated value. For the purposes of the present disclosure, the phrase "at least one of A and B" is equivalent to "A and/or B" or vice versa, namely "A" alone, "B" alone or "A and B.". Similarly, the phrase "at least one of A, B, and C," for example, means (A), (B), (C), (A and B), (A and C), (B and C), or (A, B, and C), including all further possible permutations when greater than three elements are listed.

The principles, representative embodiments, and modes of operation of the present disclosure have been described in the foregoing description. However, aspects of the present disclosure which are intended to be protected are not to be construed as limited to the particular embodiments disclosed. Further, the embodiments described herein are to be regarded as illustrative rather than restrictive. It will be appreciated that variations and changes may be made by others, and equivalents employed, without departing from the spirit of the present disclosure. Accordingly, it is expressly intended that all such variations, changes, and equivalents fall within the spirit and scope of the present disclosure, as claimed.

The embodiments of the invention in which an exclusive property or privilege is claimed are defined as follows:

1. A radio frequency connector for establishing a radio frequency connection with a radio frequency device, the radio frequency connector having a dissembled state, the radio frequency connector comprising:

a radio frequency connection interface;

an interchangeable radio frequency adapter providing at a free end a radio frequency interface configured to be connected to a radio frequency device, said interchangeable radio frequency adapter being put on said radio frequency connection interface such that said interchangeable radio frequency adapter accommodates said radio frequency connection interface at least partly, said interchangeable radio frequency adapter being detachably attached with said radio frequency connection interface such that said interchangeable radio frequency adapter is configured to be detached from said radio frequency connection interface in the disassembled state;

a detachable positioning member configured to position said interchangeable radio frequency adapter with respect to said radio frequency connection interface in an assembled state of said radio frequency connector, wherein said positioning member is configured to be detached from the radio frequency connection interface in the disassembled state of the radio frequency connector, thereby also releasing said interchangeable radio frequency adapter with respect to said radio frequency connection interface; and a base comprising a passage into which said radio frequency connection interface and said interchangeable radio frequency adapter extend at least partly, said passage having a threaded section that interacts with a threaded section of said interchangeable radio frequency adapter via which said interchangeable radio frequency adapter is screwed in.

2. The radio frequency connector according to claim 1, wherein said positioning member also locks said interchangeable radio frequency adapter with respect to said radio frequency connection interface in said assembled state of said radio frequency connector.

3. The radio frequency connector according to claim 1, wherein said radio frequency connector comprises the base.

4. The radio frequency connector according to claim 3, wherein said positioning member is in engagement with said base in said assembled state of the radio frequency connector.

5. The radio frequency connector according to claim 4, wherein said engagement between said positioning member and said base is established by a threaded connection.

6. The radio frequency connector according to claim 1, wherein said positioning member accommodates said interchangeable radio frequency adapter circumferentially.

7. The radio frequency connector according to claim 1, wherein said interchangeable radio frequency adapter has a protrusion.

8. The radio frequency connector according to claim 7, wherein said positioning member has an inner shoulder portion that engages with said protrusion.

9. The radio frequency connector according to claim 1, wherein said positioning member has an outer rim portion to be engaged with a second radio frequency device with which the radio frequency connector establishes the radio frequency connection.

10. The radio frequency connector according to claim 1, wherein said radio frequency connection interface is a coaxial radio frequency connection interface.

11. The radio frequency connector according to claim 1, wherein said interchangeable radio frequency adapter is an interchangeable coaxial radio frequency adapter.

12. A measurement system for radio frequency measurement, said measurement system comprising;

a radio frequency device with at least one radio frequency port and a radio frequency connector for establishing a radio frequency connection with the radio frequency device, wherein the radio frequency connector comprises a radio frequency connection interface, an interchangeable radio frequency adapter, a positioning member, and a base to which said positioning member is attached in an assembled state by a threaded connection, said interchangeable radio frequency adapter being detachably attached with said radio frequency connection interface such that said interchangeable radio frequency adapter is configured to be detached from said radio frequency connection interface in a disassembled state of the radio frequency connector;

said positioning member being configured to position said interchangeable radio frequency adapter with respect to said radio frequency connection interface in the assembled state of said radio frequency connector;

said base comprising a passage into which said radio frequency connection interface and said interchangeable radio frequency adapter extend at least partly in the assembled state of said radio frequency connector, said passage having a threaded section that interacts with a threaded section of said interchangeable radio frequency adapter via which, in the assembled state of said radio frequency connector, said interchangeable radio frequency adapter is screwed in; and said positioning member being configured to be detached from the radio frequency connection interface or the interchangeable radio frequency adapter in the disassembled state of the radio frequency connector, thereby releasing said interchangeable radio frequency adapter with respect to said radio frequency connection interface, wherein said radio frequency connector provides a sacrificial interface to the radio frequency device, thereby protecting the radio frequency port from mechanical damage, and wherein said radio frequency connection interface is established by said radio frequency port of said radio frequency device.

13. The measurement system according to claim 12, wherein said measurement system also comprises a second radio frequency device that is connected with the radio frequency connector.

14. The measurement system according to claim 13, wherein said second radio frequency device is connected with a free end of said interchangeable radio frequency adapter, said free end being located opposite to said radio frequency connection interface.

15. The measurement system according to claim 13, wherein said second radio frequency device is a probe device.

16. The measurement system according to claim 12, wherein said radio frequency device is an oscilloscope, a network analyzer, a signal generator, a signal analyzer or a spectrum analyzer.

17. The measurement system according to claim 12, further comprising a second interchangeable radio frequency adapter, wherein the second interchangeable radio frequency adapter has a different size compared to the interchangeable radio frequency adapter.

18. The measurement system according to claim 12, wherein said interchangeable radio frequency adapter providing at its free end a radio frequency interface to be connected by external devices, and said interchangeable radio frequency adapter being put on said radio frequency connection interface such that said interchangeable radio frequency adapter accommodates said radio frequency connection interface at least partly.

19. A radio frequency connector for establishing a radio frequency connection with a radio frequency device, the radio frequency connector having a dissembled state and an assembled state, the radio frequency connector, comprising:

a radio frequency connection interface;

an interchangeable radio frequency adapter, wherein said interchangeable radio frequency adapter is configured to be detachably attached with said radio frequency connection interface such that said interchangeable radio frequency adapter is detached from said radio frequency connection interface in the disassembled state; and a positioning member and a base to which said positioning member is attached in the assembled state of the radio frequency connector, said base comprising a passage into which said radio frequency connection interface and said interchangeable radio frequency adapter extend at least partly, said passage having a threaded section that interacts with a threaded section of said interchangeable radio frequency adapter via which said interchangeable radio frequency adapter is screwed in, said positioning member having an inner thread portion that interacts with an outer thread portion provided at said base such that said positioning member is screwed onto said base, said positioning member being configured to position said interchangeable radio frequency adapter with respect to said radio frequency connection interface in the assembled state, said positioning member having an inner shoulder portion that engages with a protrusion provided at an outer surface of said interchangeable radio frequency adapter, wherein interaction between said protrusion and said inner shoulder portion ensures that said interchangeable radio frequency adapter is aligned in a radial direction and the axial direction with respect to said radio frequency connection interface when said positioning member is attached to said base;

said positioning member configured to be detachably attached such that said positioning member is able to be detached in the disassembled state of the radio frequency connector, thereby allowing detachment of said interchangeable radio frequency adapter with respect to said radio frequency connection interface.

* * * * *